United States Patent [19]

Stahl

[11] Patent Number: 4,501,990

[45] Date of Patent: Feb. 26, 1985

[54] ELECTRON TUBE, ESPECIALLY TRANSMITTING TUBE, WITH A DEVICE FOR ELIMINATING INTERFERING RETARDING-FIELD EFFECTS

[75] Inventor: Jochen Stahl, Berlin, Fed. Rep. of Germany

[73] Assignee: Siemens Aktiengesellschaft, Berlin and Munich, Fed. Rep. of Germany

[21] Appl. No.: 563,001

[22] Filed: Dec. 16, 1983

Related U.S. Application Data

[63] Continuation of Ser. No. 282,720, Jul. 13, 1981, abandoned.

[30] Foreign Application Priority Data

Jul. 22, 1980 [DE] Fed. Rep. of Germany ..... 3027756

[51] Int. Cl.[3] ..... H01J 1/46; H01J 21/10

[52] U.S. Cl. ..... 313/299; 313/156; 313/157; 313/293

[58] Field of Search ..... 313/299, 293, 257, 156, 313/157; 315/39

[56] References Cited

U.S. PATENT DOCUMENTS 2,248,712 7/1941 Litton ..... 313/157
2,727,177 12/1955 Dailey et al. ..... 313/299 X
2,898,504 8/1959 Norton ..... 313/299
3,562,576 2/1971 Rusterholz ..... 313/299
3,610,996 10/1971 Rusterholz ..... 313/299

FOREIGN PATENT DOCUMENTS 2625021 9/1978 Fed. Rep. of Germany ..... 313/299

OTHER PUBLICATIONS

Publication Lexikon der Hochfrequenz-, Nachrichten-und Elektrotechnik, Publisher Curt Rint.

*Primary Examiner*—Saxfield Chatmon
*Attorney, Agent, or Firm*—Herbert L. Lerner; Laurence A. Greenberg

[57] ABSTRACT

Electron tube assemble having coaxial electrodes and grids, including a tube with given electron trajectories and oscillation period, and interfering retarding-field effect elimination means disposed around the tube for generating a magnetic field having field lines running inside the tube substantially parallel to the electrodes and grids deflecting the trajectories of the electrons moving radially with respect to the anode during operation of the tube and substantially perpendicularly intersecting and elongating the trajectories of the electrons for increasing the oscillation period of the electrons and eliminating interfering retarding-field effects.

6 Claims, 4 Drawing Figures

ELECTRON TUBE, ESPECIALLY TRANSMITTING TUBE, WITH A DEVICE FOR ELIMINATING INTERFERING RETARDING-FIELD EFFECTS

This application is a continuation of application Ser. No. 282,720, filed July 13, 1981, now abandoned.

The invention relates to an electron tube, especially a transmitting tube, with a coaxial construction of the electrodes and their grids.

Such electron tubes are generally known such as from German Patent DE-PS No. 26 25 021.

It is also known to provide means, in a high vacuum electron tube having electrodes disposed along cylindrical surfaces and several incandescent cathodes, for the generation of a magnetic field parallel to the cylindrical electrode surfaces. These generation means are provided in order to have the magnetic field help keep the electron stream away from the control electrodes at positive control potential of the control electrodes and thus be able to reduce the control power. Such a device is shown in U.S. Pat. No. 3,610,996 and Swiss Patent CH-PS No. 483 116 corresponding thereto.

In the heretofore customary applications, transmitting tubes were always operated at residual plate voltages equal to the screen grid voltage in tetrodes and equal to the positive control grid voltage in triodes. Operation at lower residual plate voltages was not possible with conventional grid technology for reasons of limited screen grid and control grid loading.

Only in special application as a pulse width modulator tube (PDM tube) and greater loading of the grids in modern grid technology as a prerequisite, is operation at zero residual plate voltage desired in order to obtain the better efficiency associated therewith.

However, with higher modulation and residual plate voltages near zero, interfering retarding-field effects will occur in electron tubes. These effects are also called Barkhausen-Kurz oscillations, such as is shown in the publication Lexikon der Hochfrequenz-, Nachrichten- und Elektrotechnik by Rint: (High Frequency, Communications and Electrical Engineering Lexicon,) Vol. 1, 1957, pages 527 and 528.

It is accordingly an object of the invention to provide an electron tube, especially transmitting tube, with a device for eliminating interference retarding-field effects, which overcomes the hereinafore-mentioned disadvantages of the heretofore-known devices of this general type, to do so at high modulation with residual plate voltages near zero, and to eliminate the interfering retarding-field effects (Barkhausen-Kurz oscillations) in order to create, in particular, a PDM tube of high efficiency.

With the foregoing and other objects in view there is provided, in accordance with the invention, an electron tube, especially transmitting tube, assembly having coaxial electrodes and grids, comprising a tube with given electron trajectories and oscillation period, and elimination means for aforesaid interfering retarding-field effect disposed around the tube for generating a magnetic field having field lines running inside the tube substantially parallel to the electrodes and grids deflecting the trajectories of the electrons moving radially with respect to the anode during operation of the tube and substantially perpendicularly intersecting and elongating the trajectories of the electrons for increasing the oscillation period of the electrons and eliminating interfering retarding-field effects.

According to the invention, the electrons moving radially to the anode are deflected by the magnetic field disposed almost perpendicular thereto so that their trajectory becomes longer.

In accordance with another feature of the invention, this is expediently accomplished by a relatively small magnetic induction B, wherein the elimination means has a magnetic induction of approximately 200 Gauss which is equal to $200\times10^{-8}$ Vsec/cm$^2$, which increases the oscillation period of the electrons so that the interfering retarding-field effect of the electrons disappears completely.

In accordance with a further feature of the invention, the elimination means is in the form of a permanent magnet system.

In accordance with an added feature of the invention, the permanent magnet system includes a plurality of ploe piece segments disposed around the tube.

In accordance with an additional feature of the invention, the elimination means is in the form of an electromagnet system with current-carrying coils.

In accordance with a concomitant feature of the invention, the elimination means has a magnetizing current which is the anode operating current of the tube.

The invention offers the advantage that the electron tube, especially transmitting tube, makes operation at zero residual plate voltage achievable, and the increased ifficiency associated therewith allows the application of the tube as a PDM tube.

Other features which are considered as characteristic for the invention are set forth in the appended claims.

Although the invention is illustrated and described herein as embodied in electron tube, especially transmitting tube, with a device for eliminating interfering retarding-field effects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description or specific embodiments when read in connection with the accompanying drawings in which.

Figure 3:
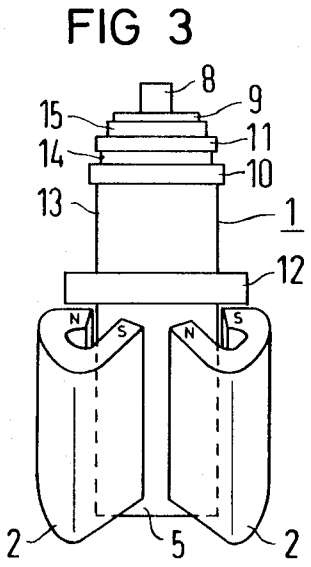
FIG. 3 is a side-elevational view of an electron tube with a modified permanent magnet system.
Figure 2:
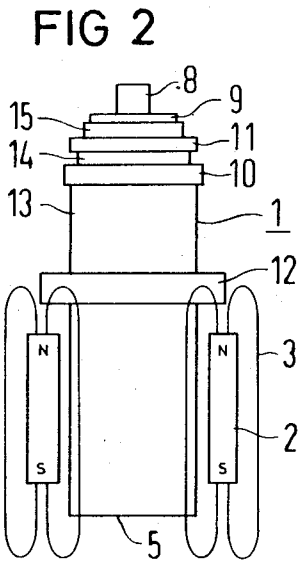
FIG. 2 is a view similar to FIG. 1 of an electron tube with a permanent magnet system.
Figure 1:
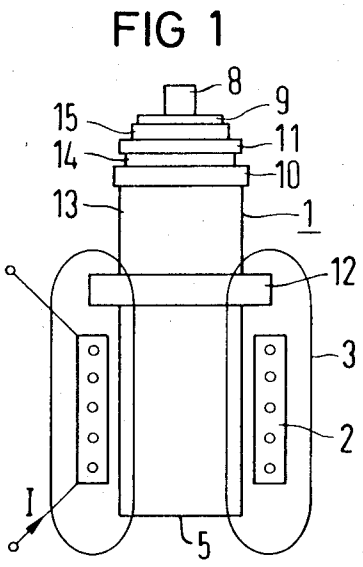
FIG. 1 is a diagrammatic elevational view of an electron tube with an electromagnet system.
Figure 4:
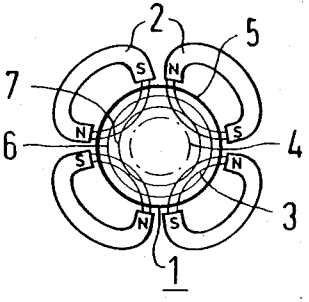
FIG. 4 is a top plan view of the electron tube with a permanent magnet system according to FIG. 3.

Referring now particularly to FIGS. 1 to 4 of the drawing as a whole, there is seen an illustration of a tetrode as the electron tube 1. The electrodes, i.e. the cathode 4 and the anode 5, as well as the grids, i.e. the screen grid 6 and control grid 7, are coaxial or concentric with each other, as seen in FIG. 4. FIGS. 1 to 3 show a heater lead 8 of the cathode 4 having a terminal 9 which is visible. The screen grid terminal 10 and the control grid terminal 11 are also shown. A cylinder of the anode 5 is, for example, fastened to an anode flange 12. Between the anode flange 12 and the screen grid terminal 10, there is disposed an insulating section 13 formed of a material such as glass or ceramic. Other insulating sections 14, 15 are disposed between the screen grid terminal 10 and the control grid terminal 11 as well as between the control terminal 11 and the cathode lead 9, respectively.

To eliminate interfering retarding-field effects, a device 2 for generating a magnetic field is disposed around the tube 1. The device 2 has field lines inside the tube 1, which run essentially parallel to the cathode 4 and anode 5 as well as to the screen grid 6 and control grid 7. During the operation of the tube 1, the electrons travel radially from the cathode 4 to the anode 5.

The trajectories of the electrons are intersected essentially perpendicularly by the field lines 3. This causes the electrons to be deflected into circular orbits which have become longer. The consequence thereof is that the oscillation period of the deflected electrons is increased so that the interfering retarding-field oscillations are eliminated.

The device 2 shown in FIG. 1 for generating the magnetic field 3 includes a coil through which a current I flows. The device 2 shown in FIG. 2 is a cylindrical permanent magnet coaxially enclosing the tube 1. A permanent magnet system is also used to generate a magnetic field 3 in the embodiment example shown in FIGS. 3 and 4. In that embodiment example, the permanent magnet system of the device 2 includes several substantially kidney or hook-shaped pole piece segments which are disposed around the tube 1 and have longitudinal axes which run parallel to the longitudinal axis of the electron tube 1.

There are claimed:

1. In an electron tube assembly, having:

an electron tube with given electron trajectories and a given electron oscillation period;

coaxial anode and cathode electrodes and grids each defined substantially by coaxial cylindrical surfaces; the improvement which comprises:

means disposed around said tube for generating a magnetic field for operating said tube at higher modulation and with residual plate voltages near zero to eliminate interfering retarding field effect oscillations;

said magnetic field having field lines running inside said tube substantially parallel to the cylindrical surfaces of the electrodes and grids, said field lines substantially perpendicularly intersecting the trajectories of the electrons moving radially from the cathode electrode to the anode electrode during operation of said electron tube, and said field lines elongating the trajectories of the electrons for increasing the oscillation period of the electrons and thereby eliminating interfering retarding field effect oscillations at anode voltages that are close to zero potential.

2. Electron tube assembly according to claim 1, wherein said generating means has a magnetic induction of said magnetic field of $2.10^{-2}$ Tesla.

3. Electron tube assembly according to claim 1 or 2, wherein said generating means is in the form of a permanent magnet system.

4. Electron tube assembly according to claim 3, wherein said permanent magnet system includes a plurality of pole piece segments disposed around said tube.

5. Electron tube assembly according to claim 1 or 2, wherein said generating means is in the form of an electromagnet system.

6. Electron tube assembly according to claim 5, wherein said generating means has a magnetizing current which is the anode operating current of said tube.

* * * * *